United States Patent [19]

Maillefer

[11] 3,941,166

[45] Mar. 2, 1976

[54] MACHINE FOR ALTERNATE TWISTING OF WIRE OR CABLE

[75] Inventor: Henri Maillefer, Cossonay, Switzerland

[73] Assignee: Maillefer S.A., Ecublens, Switzerland

[22] Filed: Nov. 5, 1974

[21] Appl. No.: 521,155

[30] Foreign Application Priority Data

Nov. 7, 1973 Switzerland ..... 15626/73

[52] U.S. Cl. ..... 140/149; 57/34 AT

[51] Int. Cl.[2] ..... B21F 7/00

[58] Field of Search ..... 140/115, 149; 57/51, 51.4, 57/77.3, 77.42, 77.45, 34 AT, 58.84, 156, 91, 62

[56] References Cited

UNITED STATES PATENTS

| | | | |
|---|---|---|---|
| 919,309 | 4/1909 | Blessing | 57/77.42 |
| 1,474,131 | 11/1923 | Zachariadis | 57/51.4 |
| 2,427,955 | 9/1947 | Furness | 57/51.4 |
| 2,941,348 | 6/1960 | Biche et al. | 57/62 |
| 3,365,871 | 1/1968 | Schatz et al. | 57/58.84 |
| 3,507,108 | 4/1970 | Yoshimura et al. | 57/156 |
| 3,823,536 | 7/1974 | Vogelsberg et al. | 57/156 |

*Primary Examiner*—Lowell A. Larson

*Attorney, Agent, or Firm*—Stevens, Davis, Miller & Mosher

[57] ABSTRACT

A machine for alternate twisting of metal wire or cable, comprising a frame and a storage unit provided with two end-positioned twisting members and alternately driven about the axis of the wire or cable in first one direction and then the other, wherein the storage unit is linear and comprises a straight cable-supporting tube through which the wire or cable passes and which is caused to rotate at a speed equal to or greater than that of the twisting members and always in the same direction as the storage unit.

9 Claims, 5 Drawing Figures

MACHINE FOR ALTERNATE TWISTING OF WIRE OR CABLE

Figure 1:
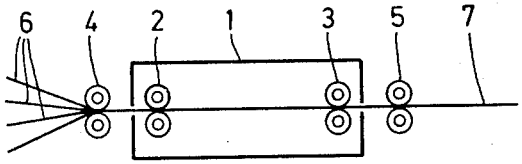

This invention relates to a machine for alternate twisting of metal wire or cable, comprising a frame and a storage unit provided with two end-positioned twisting members and alternately driven about the axis of the wire or cable in first one direction and then the other.

Alternate twisting is a method of manufacturing cable which is already known in principle and which is known to present great advantages over conventional methods. It enables twisting to be carried out continuously with installations which are lighter and more compact than those used previously. It also makes it possible to insert a twisting operation in a production line which carries out other operations.

However, the alternate twisting machines presently known are not capable of providing the advantages of this method to the fullest extent desirable. This will become readily apparent upon consideration, to begin with, of FIG. 1 of the accompanying drawings, which is a diagram of a known wire-twisting machine with a linear storage unit operating on the alternate-twisting principle. The linear storage unit comprises a cage 1 bearing two twisting members 2 and 3 at its respective ends. Each of these twisting members consists of two pulleys disposed one on each side of the cable and gripping it between them. The up-line twisting member 4 and the down-line twisting member 5 are stationary. They, too, consist of two opposing pulleys each. Other systems of twisting members may also be used.

The several wires 6 which comprise the cable come from delivery reels (not shown) mounted on a stationary support. After twisting, the cable 7 is wound on a take-up reel which is likewise mounted on a stationary frame. It might also be taken up by a machine performing a subsequent operation on the cable in tandem with the twisting operation. The twisting is effected by alternately rotating the entire storage unit (1, 2, 3) about the axis of the cable 7, first in one direction and then in the other, and the period of time between reversals of the direction of rotation is equal to the time it takes for a given point on the cable to travel the distance between the two twisting members 2 and 3. While the storage unit is turning in one direction, the cable undergoes a first twist in one direction, e.g., a right-hand twist between the twisting members 2 and 4, and a second twist in the opposite direction, i.e., a left-hand twist, between the twisting members 3 and 5. In the zone comprised between the two twisting members 2 and 3, its state of twist remains constant. If the direction of rotation of the cage 1 is reversed at the moment when the first point of the cable which has undergone the right-hand twist is situated in line with the twisting member 3, this point, as well as the portion of the cable which is in the storage unit at the moment of reversal, will undergo a second right-hand twist upon passing into the zone between 3 and 5, while the portion of the cable which has meanwhile come into the zone between 4 and 2 will undergo a left-hand twist. Thus the cable in its final state is twisted alternately in the positive and in the negative direction, the lengths of the segments with the same twist being equal to the length of the storage unit.

The cable therefore comprises points of reversal of the direction of twist which are spaced from one another by a distance equal to the length of the storage unit. The production of machines for alternate twisting which are capable of high-speed operation requires that provision be made for preventing the cable from untwisting about these points of reversal. If a linear storage unit is used, the risk of untwisting increases with the length of the storage unit, for the portion of cable comprised between the twisting members 2 and 3 oscillates laterally because it is running free between those twisting members. In order to reduce the amplitude of these oscillations, an increase in the tension of the wire might be considered, but that step entails other drawbacks. It would also be possible to place fixed guides at regular intervals between the two twisting members, or to place one fixed guide, e.g., a tube or trough, extending all the way from one twisting member to the other. The drawback of such fixed guides is that they create friction which encourages untwisting about the points of reversal. Another idea would be to place intermediate twisting members in the cage 1, but this would tend to weigh the cage down. The attempt has also been made to replace the linear storage unit by one in which the cable is wound several times between two end-positioned pulleys which then constitute the twisting members. This arrangement makes it possible to reduce the length of the storage unit without decreasing the length of the segments twisted in the same direction. However, it also tends to weigh down the cage, and the centrifugal force which is exerted upon the portions of the cable remote from the axis of rotation of the storage unit likewise entails certain drawbacks. For example, it is not possible to make the storage unit rotate at such a high speed as would be desirable. Consequently, the running speed of the cable is limited. In practice, in certain twisting machines known heretofore, the risk of untwisting of the cable about critical points is prevented by coating it with an adhesive or binding it up.

It is the object of this invention to remedy the above-mentioned drawbacks by providing a simple and lightweight design improvement in machines for alternate twisting of wire or cable.

To this end, in the machine for alternate twisting of wire or cable according to the present invention, the storage unit is linear and comprises a straight cable-supporting tube through which the wire or cable passes and which is caused to rotate at a speed equal to or greater than that of the twisting members and always in the same direction as the storage unit.

Figure 5:
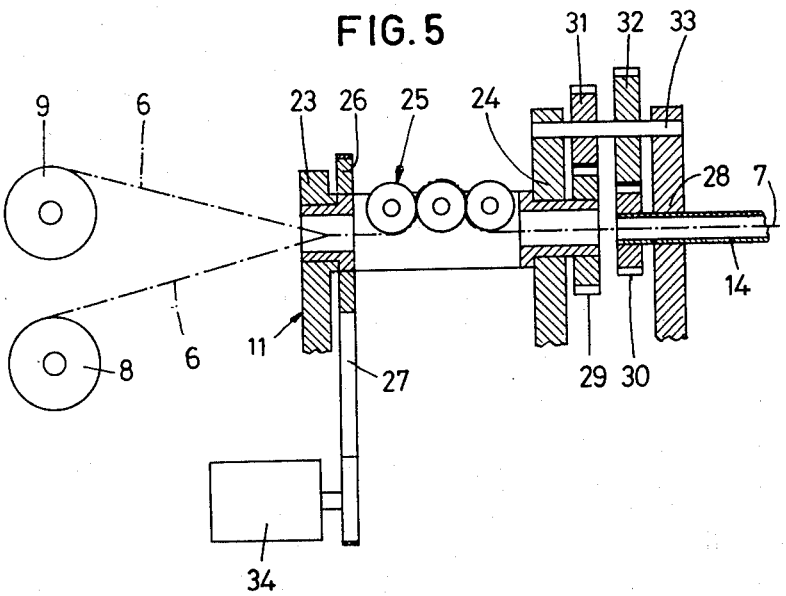
Figure 4:
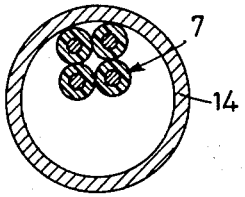
Figure 2:
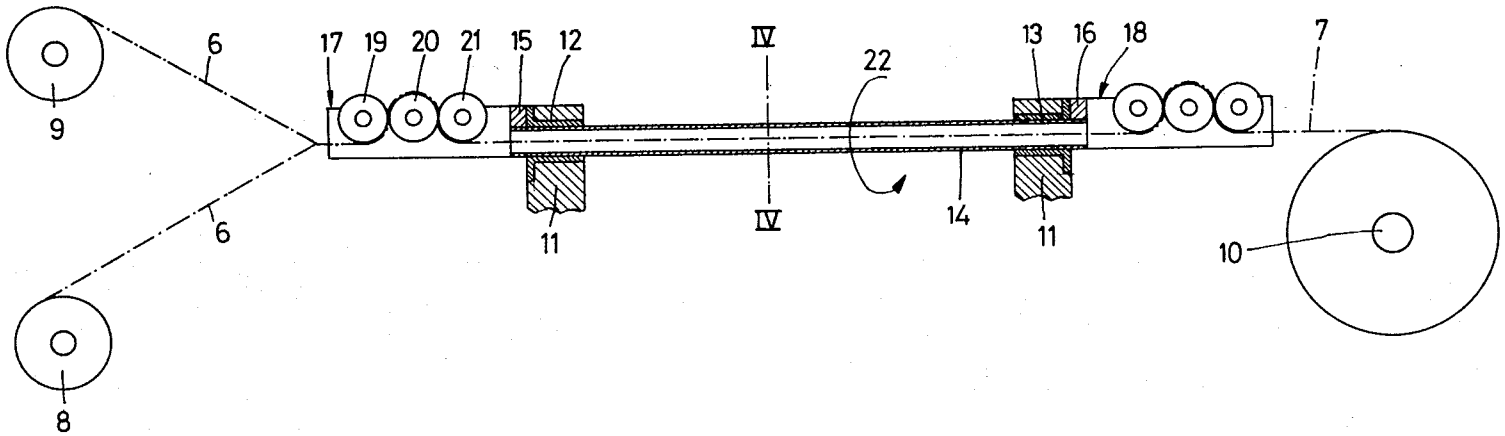
Figure 3:
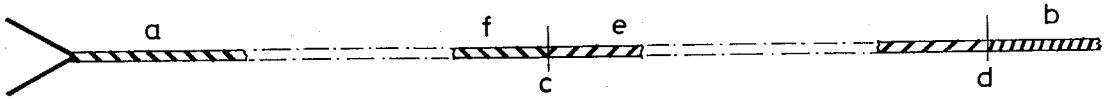

Two possible embodiments of the invention will now be described in detail with reference to FIGS. 2 to 5 of the accompanying drawings, in which:

FIG. 1 is a diagram illustrating the alternate twisting method,

FIG. 2 is a diagrammatic longitudinal section of a first embodiment of the twisting machine according to the invention, FIG. 3 is a diagram illustrating the state of twisting at three locations in the twisting machine of FIG. 2, FIG. 4 is an enlarged section taken on the line IV—IV of FIG. 2, and FIG. 5 is a diagrammatic partial longitudinal section of a second embodiment of the twisting machine according to the invention.

FIG. 2 illustrates a twisting machine which forms a cable 7 by alternate twisting of four wires 6, two of which are shown in FIG. 2. Delivery reels 8 and 9 are mounted on stationary supports at the up-line end of the twisting machine. At the downline end of the machine, the cable 7 is wound on a take-up reel 10. As a variation, the wires might come directly from wire-drawing, insulating, or cabling installations; and the cable 7, instead of being wound on the reel 10, might be led directly into another installation where it would be subjected to a subsequent operation, e.g., sheathing.

A stationary frame 11 of the machine is shown only partially in FIG. 2. It includes two bearings 12 and 13 which support a straight tube 14 constituting the cable-supporting tube. At its two ends, the tube 14 bears elements 15 and 16, respectively, which make it integral with two twisting members 17 and 18. In the embodiment illustrated, each of the twisting members 17 and 18 comprises three pulleys 19, 20, and 21, all of the same diameter, the axles of which are supported by the stirrup 16 or 15, and which are disposed in lines tangent to the axis of the tube 14. It will be seen that the cable 7 formed by the joining of the wires 6 is guided between the pulleys of the twisting member 17, then passes into the tube 14, and is again guided between the pulleys 19, 20, and 21 of the twisting member 18 before being led onto the take-up reel 10. The twisting members may be designed differently, e.g., they may be formed of two rows of opposite pulleys on each side of the cable, the latter being gripped between them. As a variation, the installation might be supplemented by stationary twisting members situated before and after the storage unit described. It will be seen that because of the path followed by the cable 7 between the pulleys 19 and 20, about the pulleys 20 and between the pulleys 20 and 21, it is subjected to twisting if the tube 14 is rotated about its own axis.

The means for driving the tube 14 rotatingly are not shown in the drawing. They may consist of a pulley mounted on the tube 14 between the bearings 12 and 13 and actuated by a belt or by a gear-drive. The essential element in the operation of the twisting machine described is that the assembly composed of the tube 14 and the frame elements 15 and 16 rotates alternately in one direction and then in the other, the intervals between the reversals of direction being equal. Moreover, these intervals are adjusted to the speed at which the cable 7 runs through the apparatus and are so regulated that they correspond to the length of time it takes for a given point on the cable to travel the distance between the twisting members 17 and 18. To give an idea of these factors, the distance in question may be 10 m., for example.

The results of this mode of operation will be understood upon considering FIG. 3, which diagrams the state of twist of the cable before the twisting member 17, within the tube 14, and after the twisting member 18.

Between the twisting members 17 and 18, the cable 7 comprises a point of reversal *c* where the direction of twist changes abruptly. Before the point of reversal *c* (zones *a, f*), the cable has taken on a right-hand twist since the storage unit is rotating in the direction of the arrow 22 in FIG. 2, whereas after the point *c* (zone *e*) it has taken on a left-hand twist. These two twists are equal to 50% of the desired final twist. The portions of the cable situated immediately after a point *d*, corresponding to the location of the twisting member 18, on the other hand, have a left-hand twist equalling 100% of the desired twist. This zone *b* of complete left-hand twist extends down-line to the following point of reversal. Within the storage unit, external disturbing influences may cause the cable to untwist before and after the point *c*. However, the presence of the tube 14, which closely surrounds the cable and rotates with it, prevents such untwisting. This is because the cable tends to lie pressed against the inside wall of the tube 14 owing to centrifugal force, as shown in FIG. 4; and since the tube rotates along with the cable, the latter is not subjected to any disturbing friction. The risk of untwisting within the storage unit is therefore considerably, if not even totally, eliminated without weighing down the machine. It is possible to extend the length of the linear storage unit to the full extent allowed by the amount of space available. If need be, the tube 14 might easily be supported by intermediate bearings.

FIG. 5 illustrates another embodiment in which the action of the tube 14 upon the cable 7 is still further improved by causing the tube 14 to rotate faster than the cable 7. This figure again shows the delivery reels 8 and 9 from which emanate the wires 6 making up the cable 7. Here, the frame 11 of the machine includes two bearings 23 and 24 supporting an up-line twisting member 25 comprising three cable-guiding pulleys, as in the first embodiment, plus a driving pulley 26. A belt 27 and a motor 34 drive the pulley 26 rotatingly. The twisting member 25 is independent of the supporting tube 14, which is borne by bearings such as a bearing 28. Moreover, the down-line end of the twisting member 25 and the up-line end of the tube 14 carry toothed wheels 29 and 30 which mesh with wheels 31 and 32 mounted on a shaft 33 borne by the frame 11. The ratios of this gearing are such that the tube 14 continuously rotates at a higher speed than the twisting member 25, whatever its direction of rotation. It will be realized that when an arrangement similar to that of FIG. 5 is also provided at the other end of the storage unit, the downline twisting member is likewise driven at the same speed as the up-line twisting member. In still another embodiment, the two twisting members might be integral with one another and connected by an outside transmission shaft, for instance. The tube 14 would be driven from the cage of the storage unit via a planet-gear which would cause it to rotate faster than the twisting members. In comparison to FIGS. 2 and 3, it will be seen that in these last-mentioned embodiments, the tube 14 prevents the cable from untwisting at the points of reversal still more efficiently, even tending to cause the wires forming the cable to press more tightly together.

The twisting machine described here makaes alternate twisting possible at a much higher speed than has been feasible until now. The support tube may, indeed, be very small in diameter. It suffices for it to guide the cable without braking it. It may be of considerable length and be supported by several bearings. Its low-inertia mass enables it to be rotated rapidly and to change rotating direction very abruptly.

It has been found that a 2:1 ratio between the inside diameter of the support tube and the diameter of the cable gives satisfactory results. However this ratio is not compulsory. The tube may also have a larger or smaller diameter. The minimum diameter is determined by the fact that the friction in the longitudinal direction should not be too great. As for the maximum diameter, it is limited by the fact that the tube should support and stabilize the cable, with the latter resting against its inside surface.

What is claimed is:

1. Apparatus for alternate twisting of metal wire or cable; comprising:

a frame;

a linear storage unit comprising a straight cable-supporting tube through which said wire or cable passes,, said tube mounted to said frame for rotation about its longitudinal axis;

first and second twisting means mounted to said frame at and coupled to exterior opposite ends of said tube, said wire or cable passing through said first twisting means prior to entering said linear storage unit and through said second twisting means after exiting from said linear storage unit; and means for rotating said storage unit and said twisting means alternately in opposite directions about the longitudinal axis of siad cable-supporting tube such that said tube rotates in the same direction as and at a speed which is not less than the speed of rotation of said twisting means.

2. The apparatus according to claim 1, wherein said first and second twisting means each comprises a plurality of rotatable pulleys over which said cable or wire is passed, said pulleys being mounted to respective twisting members for free rotation about each pulley axis and for rotation with said storage unit about said longitudinal axis.

3. The apparatus according to claim 1, wherein said twisting means each comprises a plurality of rollers mounted to respective support members transverse to an tangential to the longitudinal axis of said cable support tube.

4. The apparatus according to claim 1, wherein the period of rotation of said storage unit in one direction is a function of the length of said tube.

5. The apparatus according to claim 4, wherein the period of rotation of said storage unit in said one direction is substantially equal to the time required for a given point on said wire or cable to travel between said first and second twisting means.

6. A twisting machine in accordance with claim 1, wherein the diameter of said tube is about twice that of said wire or cable.

7. A twisting machine in accordance with claim 1, wherein said twisting means comprise frames which are integral with said tube.

8. A twisting machine in accordance with claim 1, wherein said tube is connected to said twisting means by a transmission means in such a way as always to rotate in the same direction as said twisting means but at a higher speed than said twisting means.

9. A twisting machine in accordance with claim 8, wherein said twisting means are supported independently of one another and said transmission means is mounted on said frame between each of said twisting means and said tube.

* * * * *